US006361680B1

(12) United States Patent
Sekhar et al.

(10) Patent No.: US 6,361,680 B1
(45) Date of Patent: Mar. 26, 2002

(54) ULTRASTABLE CELL COMPONENT FOR ALUMINUM PRODUCTION CELLS AND METHOD

(75) Inventors: Jainagesh Akkavaju Sekhar, Cincinnati, OH (US); Vittorio de Nora, Nassau (BS)

(73) Assignee: Moltech Invent S-A., Luxembourg ( * ) Notice: Subject to any disclaimer, the term of this patent is extended or adjusted under 35 U.S.C. 154(b) by 0 days.

(21) Appl. No.: 09/284,523

(22) PCT Filed: Sep. 23, 1997

(86) PCT No.: PCT/US97/16865

§ 371 Date: Oct. 22, 1999

§ 102(e) Date: Oct. 22, 1999

(87) PCT Pub. No.: WO98/12363

PCT Pub. Date: Mar. 26, 1998

(51) Int. Cl.[7] ..... C25C 3/08; C25C 3/00; C25B 11/00

(52) U.S. Cl. ..... 205/385; 204/243.1; 204/247.3; 204/290.1; 204/290.01; 204/290.12; 204/290.13; 29/592.1

(58) Field of Search ..... 204/243.1, 290.1, 204/290.01, 247.3, 290.12, 290.13; 29/592.1; 205/385

(56) References Cited

U.S. PATENT DOCUMENTS 5,510,008 A * 4/1996 Sekhar et al. ..... 205/384
5,720,860 A * 2/1998 Sekhar et al. ..... 204/247.3
5,904,828 A * 5/1999 Sekhar et al. ..... 205/384 X

* cited by examiner

*Primary Examiner*—Donald R. Valentine
(74) *Attorney, Agent, or Firm*—Jayadeep R. Deshmukh

(57) ABSTRACT

Method and cell component for the electrowinning of aluminum by the electrolysis of alumina dissolved in a molten fluoride electrolyte comprises a porous micropyretic reaction product of nickel, aluminum, iron, copper and at least one additive element selected from silicon, tin zinc, vanadium, indium, hafnium, tungsten, elements from the lanthanide series starting from praesodymium, and misch metal. The micropyretic reaction product contains metallic and intermetallic phases, with a composite oxide surface produced in-situ by anodic polarization of the porous micropyretic reaction product in a molten fluoride electrolyte containing dissolved alumina, or by high temperature treatment in an oxidizing gas. The composite oxide surface usually comprises an iron-rich relatively dense outer portion and an aluminate-rich relatively porous inner portion.

45 Claims, 2 Drawing Sheets

ULTRASTABLE CELL COMPONENT FOR ALUMINUM PRODUCTION CELLS AND METHOD

RELATED APPLICATION

This application is a continuation-in-part of the US designation of International application PCT/US96/15176, filed Sep. 23, 1996.

FIELD OF THE INVENTION

This invention relates to cell components, particularly anodes, for use in the electrowinning of aluminum by the electrolysis of alumina in a molten fluoride electrolyte, in particular cryolite.

The invention is more particularly concerned with the production of cell components, particularly anodes, of aluminum production cells made of composite materials by the micropyretic reaction of a mixture of reactive powders, which reaction mixture when ignited undergoes a micropyretic reaction to produce a reaction product.

BACKGROUND ART

U.S. Pat. No. 4,614,569 (Duruz et al) describes anodes for aluminum electrowinning coated with a protective coating of cerium oxyfluoride, formed in-situ in the. cell or pre-applied, this coating being maintained by the addition of certain to the cryolite electrolyte.

U.S. Pat. 4,948,676 (Darracq et al) describes a ceramic/metal composite material for use as an anode for aluminum electrowinning particularly when coated with a protective cerium oxyfluoride based coating, comprising mixed oxides of cerium and one or more of aluminum, nickel, iron and copper in the form of a skeleton of interconnected ceramic oxide grains interwoven with a metallic network of an alloy or an intermetallic compound of cerium and one or more of aluminum, nickel, iron and copper.

U.S. Pat. No. 4,909,842 (Dunmead et al) discloses the production of dense, finely grained composite materials with ceramic and metallic phases by self-propagating high temperature synthesis (SHS) with the application of mechanical pressure during or immediately after the SHS reaction.

U.S. Pat. No. 5,217,583 (Sekhar et al) describes the production of ceramic or ceramic-metal electrodes for electrochemical processes, in particular for aluminum electrowinning, by micropyretic reaction of particulate or fibrous reactants with particulate or fibrous fillers and binders. The reactants included aluminum usually with titanium and boron; the binders included copper and aluminum; the fillers included various oxides, nitrides, borides, carbides and silicides. The described composites included copper/aluminum oxide-titanium diboride etc.

U.S. Pat. No. 5,316,718 (Sekhar et al) describes an improvement of U.S. Pat. No. 5,217,583 with specific fillers. The described reactants included an aluminum nickel mixture, and the binder could be a metal mixture including aluminum, nickel and up to 5 weight % copper.

U.S. Pat. Nos. 4,374,050 (Ray) and 4,374,761 (Ray) disclose anodes for aluminum electrowinning composed of a family of metal compounds including oxides. It is stated that the anodes could be formed by oxidizing a metal alloy substrate of suitable composition. However, it has been found that oxidized alloys do not produce a stable, protective oxide film but corrode during electrolysis with spalling off of the oxide. U.S. Pat. No. 4,620,905 (Tarcy et al) also discloses oxidized alloy anodes.

U.S. Pat. Nos. 4,454,015 (Ray/Rapp) and 4,678,760 (Ray) disclose aluminum production anodes made of a composite material which is an interwoven network of a ceramic and a metal formed by displacement reaction. These ceramic metal composites have not been successful.

U.S. Pat. Nos. 5,069,771, 4,960,494 and 4,956,068 (all Nyguen et al) disclose aluminum production anodes with an oxidized copper-nickel surface on an alloy substrate with a protective barrier layer. However, full protection of the alloy substrate was difficult to achieve.

U.S. Pat. No. 5,284,562 (Beck et al) discloses alloy anodes made by sintering powders of copper nickel and iron. However, these sintered alloy anodes cannot resist electrochemical attack.

Published international application WO94/24321 (Sekhar et al), discloses aluminum production anodes comprising ordered aluminide compounds of nickel, iron and titanium produced by micropyretic reaction with a cerium based colloidal carrier.

A significant improvement was described in U.S. Pat. No. 5,510,008, and in International Application WO96/12833 (Sekhar et al). Prior to this, all attempts to produce an electrode suitable as anode for aluminum production and based on metals such as nickel, aluminum, iron and copper or other metals had proven to be unsuccessful in particular due to the problem of poor adherence due partly to thermal mismatch between the metals and the oxide formed prior to or during electrolysis.

This teaching provided an anode for aluminum production where the problem of poor adherence due partly to thermal mismatch between a metal substrate and an oxide coating formed from the metal components of the substrate was resolved, the metal electrode being covered with an oxide layer which remained stable during electrolysis and protected the substrate from corrosion by the electrolyte.

Such an anode for the production aluminum by the electrolysis of alumina in a molten fluoride electrolyte comprises a porous micropyretic reaction product derived from particulate nickel, aluminum and iron, or particulate nickel, aluminum, iron and copper, optionally with small quantities of doping elements such as chromium, manganese, titanium, molybdenum, cobalt, zirconium, niobium, cerium, oxygen, boron and nitrogen included in a quantity of up to 5 wt % in total.

The porous micropyretic reaction product contained metallic and/or intermetallic phases, and a composite oxide surface formed in-situ from the metallic and intermetallic phases contained in the porous micropyretic reaction product, by anodically polarizing the micropyretic reaction product in a molten fluoride electrolyte containing dissolved alumina. The in-situ formed composite oxide surface comprised an iron-rich relatively dense outer portion, and an aluninate-rich relatively porous inner portion.

Comparative anodes of similar compositions (i.e. similar to those of the anodes of U.S. Pat. No. 5,510,008 and WO 96/12833, Sekhar et al), but prepared from alloys not having a porous structure obtained by micropyretic reaction, show poor performance. This is believed to be a result of the mismatch in thermal expansion between the oxide layer and the metallic substrate with the alloy anodes. The differences in thermal expansion coefficients allow cracks to form in the oxide layer, or the complete removal of the oxide layer from the alloy, which induced corrosion of the anode by penetration of the bath materials, leading to short useful lifetimes.

In contrast, the porous anodes according to U.S. Pat. No. 5,510,008 and WO 96/12833 (Sekhar et al) accommodate the thermal expansion, leaving the dense protective oxide layer intact. Bath materials such as cryolite which may penetrate the porous metal during formation of the oxide layer become sealed off from the electrolyte, and from the active outer surface of the anode where electrolysis takes place, and did not lead to corrosion but remain inert inside the electrochemically inactive inner part of the anode.

These in-situ oxidized anodes represent a considerable improvement over earlier proposals. However, the composite oxide layer of these in-situ oxidized anodes of U.S. Pat. No. 5,510,008 and WO96/12833 (Sekhar et al) may grow to a thickness that reduces process efficiency, which limits the useful lifetime of the anodes. Attempts to remove this limitation of the anodes by including the additives disclosed in U.S. Pat. No. 5,510,008 and WO96/12833 (Sekhar et al) were not successful, in that such additives were found either not to have an effect of limiting the growth rate of the thickness of the oxide layer, or a thickness limiting effect was achieved but to an inadequate amount and/or this effect would be offset by problems of contamination of the product aluminum.

SUMMARY OF THE INVENTION

The invention is based on the discovery that the performance of the anodes of U.S. Pat. No. 5,510,008 and WO96/12833 is unexpectably improved by certain additive elements.

The invention relates to a cell component, preferably an anode, for the electrowinning of aluminum by the electrolysis of alumina dissolved in a molten fluoride electrolyte, comprising a porous micropyretic reaction product of particulate nickel, aluminum, iron and optionally, copper, and of at least one additive element in an effective amount usually up to 8 wt % of the total, the porous micropyretic reaction product containing metallic and intermetallic phases which preferably form a composite oxide surface layer, more preferably comprising an iron-rich relatively dense outer portion and an aluminate-rich relatively porous inner portion, wherein said layer is formed when the porous micropyretic reaction product is anodically polarized in a molten fluoride electrolyte containing dissolved alumina, or is oxidised by being subjected to contact with oxygen at high temperatures. After electrolysis or oxidation, the product comprises a porous core and the composite oxide surface. Thus, the product can be characterized as a "graded" material.

According to the invention, the overall performance of the prior art electrodes of U.S. Pat. No. 5,510,008 and WO96/12833 (Sekhar et al) is greatly enhanced by using, as an additive element, at least one element from the group consisting of silicon, tin, zinc, vanadium, indium, hafnium, tungsten, elements from the lanthanide series starting from praesodymium and misch metal. The combustion behavior of the reactant mixture is improved considerably as will be explained in greater detail below.

With these additive elements, it has been discovered that the composite oxide surface layer formed in-situ when the cell components are used as anodes grows to a thickness which is much less than the thickness obtained with the best formulations disclosed in the prior art. This is due to the much smaller thickness growth rate observed for the cell components of the present invention. As a result, anodes according to the invention can operate at a lower overvoltage, and for a considerably longer useful life.

The composition of the micropyretic reaction product is important to the formation of a dense composite oxide surface preferably comprising an iron-rich relatively dense outer portion which is associated with an aluminate-rich relatively porous inner portion by diffusion of the metals/oxides during the in-situ production of the oxide surface.

The micropyretic reaction product is preferably produced from the particulate nickel, aluminum, iron, copper and the additive element in the amounts 50–90 wt % nickel, 3–20 wt % aluminum, 5–20 wt % iron, 0–15 wt % copper and 0.5–5 wt % of said at least one additive element from the group consisting of silicon, tin, zinc, vanadium, indium, hafnium, tungsten, elements from the lanthanide series starting from praesodymium and misch metal and optionally other additives. More preferably still, the micropyretic reaction product is produced from 60–80 wt % nickel, 3–10 wt % aluminum, 5–20 wt % iron and 5–15 wt % copper, plus 0.5–5 wt % of the selected additive element(s).

In micropyretic synthesis, it is known that the ignition temperature $T_i$ and the combustion temperature $T_c$ are important processing parameters. See, for example, *Processing of Composite Materials by the Micropyretic Synthesis Method*, M. Fu and J. A. Sekhar, Key Eng. Mat., Trans. Tech Publications, vol. 108–110, pp. 19–44 (1995)). It has bee noted when using the compositions of the present invention that the combustion temperature decreased with the presence of iron, copper and zinc, which do not contribute to the energy developed during the reaction. Contrarily the combustion temperature increased with the presence of nickel, aluminum, silicon or tin, because these elements participate in the micropyretic reaction.

Preferred embodiments of the invention include silicon, tin or zinc as additive element in an amount of 0.5 to 3 wt % of the total.

Preferred elements from the lanthanide series are praesodymium, neodymium and ytterbium as well as misch metal which is a mixture of cerium, lanthanum, neodymium and other rare-earth metals. These elements are also preferably included as additive element in an amount of 0.5 to 3 wt % of the total.

The micropyretic reactions product was tested in the absence of the additive elements for effect of the aluminum content. In the preferred aluminum content range of 3–10 wt %, the resulting composites have good adherence with cerium oxyfluoride coatings when such coatings are used for protection, and the lowest corrosion rate. Below 3 % aluminum, the composites still have low corrosion, but surface spalling is found after testing. With increasing aluminum content above 10 wt %, corrosion increases gradually, and above about 20 wt % aluminum the composites have low porosity due to the increase of combustion temperature. It is expected that these effects would continue even with the inclusion of the additive elements of the present invention.

The micropyretic reaction products were also tested in the absence of the additive elements for effect of iron content. Below 5 wt % iron or no iron, the samples have higher corrosion and a nonconducting layer is found after testing. Above 20 wt % iron, results in surface spalling after oxidation, 15 wt % being a preferred upper limit. It is expected that these effects would continue even with the inclusion of the additive elements.

The micropyretic reaction products were further tested in the absence of the additive elements for effect of copper content. Below 5 wt % copper down to 0 wt % copper results in anodes with higher corrosion rate but which are nevertheless acceptable, and more than 15 wt %, in particular more than 20 wt % copper, results in surface spalling after oxidation. In the cell components tested as anodes, it was found that the composite oxide layer is depleted in copper, whereas the unoxidized portion of the micropyretic reaction product adjacent to the aluminate rich inner portion of the oxide surface is rich in copper. It is expected that these effects would continue even with addition of the additive elements.

It is preferred to use very reactive iron and copper, by selecting a small particle size of 44 micrometers or less for these components.

The particulate nickel may advantageously have a larger particle size than the particulate aluminum, iron and copper. Large particle size nickel, for example up to about 150 micrometers, is preferred. Fine nickel particles, smaller than 10 micrometers, tend to lead to very fine NiAl, $Ni_3Al$ or NiOx particles which may increase corrosion when the finished product is used as anode. Using large nickel particles enhances the formation of aluminates such as NiAl0, NiAlFeO or FeAl0 phases on the surface, which inhibits corrosion and also promotes a porous structure. However, good results have also been obtained with nickel particles in the range 10 to 20 micrometers, these small nickel particles leading to a finer and more homogenous porous microstructure.

It is recommended to use aluminum particles in the size range 5 to 20 micrometers. Very large aluminum particles (100 mesh) tend to react incompletely. Very fine aluminum particles, below 5 micrometers, tend to have a strong oxidation before the micropyretic reaction, which may result in corrosion when the finished product is used as an anode.

The powder mixture may be compacted preferably by uniaxial pressing usually at about 200–250 Mpa, or cold isostatic pressing (CIP), and the micropyretic reaction may be ignited in air or an inert atmosphere such as argon. The thermal explosion mode of micropyretic synthesis is preferred, at about 1000° C. Excellent results have been obtained with combustion in air. The powder mixture is preferably compacted dry, such as by ball milling. Alternatively, liquid binders may be used for compaction.

The micropyretic reaction (also called self propagating high temperature synthesis or combustion synthesis), can be initiated by applying local heat to one or more points of the reaction body by a convenient heat source such as an electric arc, electric spark, flame, welding electrode, microwaves or laser to initiate a reaction which propagates through the reaction body along a reaction front which may be self propagating or assisted by a heat source, as in a furnace. Reaction may also be initiated by heating the entire body to initiate reaction throughout the body in a thermal explosion mode. The reaction atmosphere is not critical, and reaction can take place in ambient conditions without the application of pressure.

The micropyretic reaction product has a porous structure comprising at least two metallic and/or intermetallic phases. Generally, the micropyretic reaction product comprises at least one intermetallic compound from the group consisting of nickel-iron, nickel-aluminum, nickel-copper, aluminum-iron, nickel-aluminum-copper and nickel-aluminum-iron-copper containing intermetallic compounds.

The porosity and microstructure of the micropyretic reaction product are important for the in-situ formation of the preferred surface oxide layer since the pores accommodate for thermal expansion, leaving the outer oxide layer intact during electrolysis.

Pre-electrolysis, the porous micropyretic reaction product may comprise nickel aluminide ($Ni_3Al$), in solid solution with copper, and possibly also in solid solution with other metals and oxides, including silicon, tin, zinc and compounds thereof (including oxides), or of the other additive elements, and mixtures. Post-electrolysis, the core of the preferred cell component/anode material comprises a major amount of Ni and $Ni_3Al$ and minor amounts of NiCu and NiFe in the substrate and a major amount of NiO and a minor amount of $NiFe_2O_4$, ZnO and $NiZnFe_2O_4$ (nickel zinc ferrite) in the mixed oxide surface layer. It is believed that the surface of such materials contains non-stoichiometric conductive oxides wherein lattice vacancies are occupied by the metals, providing an outstanding conductivity while retaining the property of ceramic oxides to resist oxidation.

During electrolysis, the aluminum is depleted from the core of the cell component/anode material, with the $Ni_3Al$ being replaced by $Ni_3Fe$. The aluminum migrates to the surface. Most of the copper is also present in the core as is the iron, because both copper and iron are highly soluble in nickel. It has been observed that $Ni_3Al$ and $Ni_3Fe$ are both considerably superior to NiAl and NiFe, respectively, in terms of corrosion resistance and oxidation resistance. Both pre- and post-electrolysis, the preferred cell components of the present invention have a predominance of $Ni_3Al$ and $Ni_3Fe$ versus NiAl and NiFe.

The micropyretic reaction product can also be produced from a mixture containing, in addition to said at least one additive element from the group consisting of silicon, tin, zinc, vanadium, indium, hafnium, tungsten, elements from the lanthanide series starting from praesodymium, and misch metal (preferably in an amount of 05. to 3 wt % of the total), an optional additional additive element from the group consisting of chromium, manganese, titanium, molybdenum, cobalt, zirconium, niobium, tantalum, yttrium, cerium, lanthanum, oxygen, boron and nitrogen. Although these additional additive elements are not as effective as silicon, tin, zinc, vanadium, indium, hafnium, tungsten, elements from the lanthanide series starting from praesodymium, and misch metal in reducing the thickness of the oxide layer, they may be included as additional "dopants" in small quantities with favorable effects. The total of the main and the additional additive elements preferably should not exceed 7 wt % of the total.

The composite oxide surface usually comprises an iron-rich relatively dense outer portion, and an aluminate-rich relatively porous inner portion which integrate into the porous structure of the substrate. Analysis of some of the specimens has shown that there is present between the iron-rich outer portion and the aluminate-rich inner portion, an aluminum-depleted intermediate portion comprising predominantly oxides of nickel and iron.

The outermost iron-rich oxide layer, when present, is a homogenous, dense layer usually comprising oxides of aluminum, iron and nickel with predominant quantities of iron, usually mainly nickel ferrite and nickel-zinc ferrite ($NiZnFe_2O_4$) doped with aluminum (when zinc is the additive element).

Nickel-zinc ferrite has been observed to have excellent properties as an anode coating material for aluminum production, even being superior to nickel ferrite. In one advantageous embodiment, the composite oxide surface comprises nickel oxide, nickel ferrite, zinc oxide and nickel-zinc ferrite.

The aluminum-depleted intermediate oxide layer, when present, usually comprises oxides of nickel and iron, with nickel highly predominant, for example iron-doped nickel oxide which provides good electrical conductivity of the anode and contributes to good resistance during electrolysis.

The innermost aluminate-rich oxide part, which is usually present, is slightly more porous that the two preceding oxide layers and is essentially an oxide of aluminum, iron and nickel, with aluminum highly predominant. This aluminate-rich part may be a homogenous phase of aluminum oxide with iron and nickel in solid solution, and usually comprises mainly iron nickel aluminate.

Minor amounts of oxides of the principal additive elements or additional additive elements may also be present in the intermediate layers.

The porous metal substrate, close to the oxide layer, often comprises nickel in solution with copper and iron and also includes small quantities of aluminum. The substrate is usually largely depleted in aluminum as the aluminum is used to create the preferred aluminate-rich part on it. Preferably, the substrate is also depleted in iron. The metallic and intermetallic core deeper inside the substrate is also preferably depleted of aluminum as a result of internal oxidation in the open pores of the material and diffusion of the oxidized aluminum to the surface. The metallic and intermetallic core (deep down in the sample), can have a similar composition to the metallic core nearer the oxide surface.

Interconnecting pores in the metal substrate may be filled with cryolite by penetration during formation of the oxide layer, but the penetrated material becomes sealed off from the electrolyte by the dense oxide coating and does not lead to corrosion inside the anode.

The invention also provides a method of manufacturing a cell component, preferably an anode, for the production of aluminum by the electrolysis of alumina in a molten fluoride electrolyte, comprising reacting a micropyretic reaction mixture of particulate nickel, aluminum, iron and optionally copper, and at least one additive element selected from the group consisting of silicon, tin, zinc, vanadium, indium, hafnium, tungsten, elements from the lanthanide series starting from praesodymium, and misch metal in an amount up to 8 wt % of the total reactants, to produce a porous micropyretic reaction product containing metallic and intermetallic phases, and preferably anodically polarizing the micropyretic reaction product in a molten fluoride electrolyte containing dissolved alumina, or subjecting it to contact with oxidizing gas at high temperatures, to produce, from the metallic and intermetallic phases contained in the porous micropyretic reaction product, an in-situ or ex-situ formed composite oxide surface usually comprising an iron-rich relatively dense outer portion and an aluminate-rich relatively porous inner portion.

Another aspect of the invention is a method of electrowinning aluminum by the electrolysis of alumina in a molten fluoride electrolyte. The electrowinning method comprises providing a starter anode, which is a porous micropyretic reaction product comprising metallic and intermetallic phases produced by reacting a micropyretic reaction mixture of particulate nickel, aluminum, iron and optionally copper, and at least one additive element from the group comprising silicon, tin, zinc, vanadium, indium, hafnium, tungsten, elements from the lanthanide series starting from praesodymium, and misch metal in an amount up to 8 wt % of the total reactants, and anodically polarizing it in a molten fluoride electrolyte containing dissolved alumina, or subjecting it to contact with oxidizing gas at high temperatures, to produce a composite oxide surface usually comprising an iron-rich relatively dense outer portion and an aluminate-rich relatively porous inner portion.

Electrolysis is then continued, using the same electrolyte (in which the in-situ oxide layer was formed) or a different molten fluoride electrolyte containing dissolved alumina, to produce aluminum using the in-situ oxidized starter anode. For example, the composite oxide surface would be formed in a cerium-free molten fluoride electrolyte containing alumina, then cerium would be added to deposit a cerium oxyfluoride based protective coating upon the composite oxide layer.

In principle, the preferred final stage of production (formation of the composite oxide layer on the anode surface) will be performed in-situ in the aluminum production cell during production of aluminum. However, for special applications, it is possible to form the in-situ oxide layer in a special electrolytic cell and then transfer the composite oxide coated cell anode to a production cell.

For uses as cell components other than anodes, it is possible to pre-form a composite oxide surface by anodic polarization or by oxidation in an oxidizing gas such as air prior to use of the component.

Yet another aspect of the present invention is a precursor of a cell component of an aluminum production cell which is ignitable to produce by micropyretic reaction, a cell component made of a composite material, said precursor comprising particulate nickel, aluminum, iron and, optionally copper, and at least one additive element selected from the group consisting of silicon, tin, zinc, vanadium, indium, hafnium, tungsten, elements from the lanthanide series starting from praesodymium, and misch metal, said additive element being present in an amount of up to 8 weight percent of the total precursor, possibly with other additives as explained above.

A coating may be applied to the preferred in-situ formed oxide layer; a preferred coating being in-situ formed cerium oxyfluoride according to U.S. Pat. No. 4,614,569 (Duruz et al). The cerium oxyfluoride may optionally contain additives such as compounds of tantalum, niobium, yttrium, praesodymium and other rare earth elements; this coating being maintained by the addition of cerium and possibly other elements to the molten cryolite-based electrolyte. Production of such a protective coating in-situ leads to dense and homogeneous cerium oxyfluoride.

DETAILED DESCRIPTION

Figure 1:
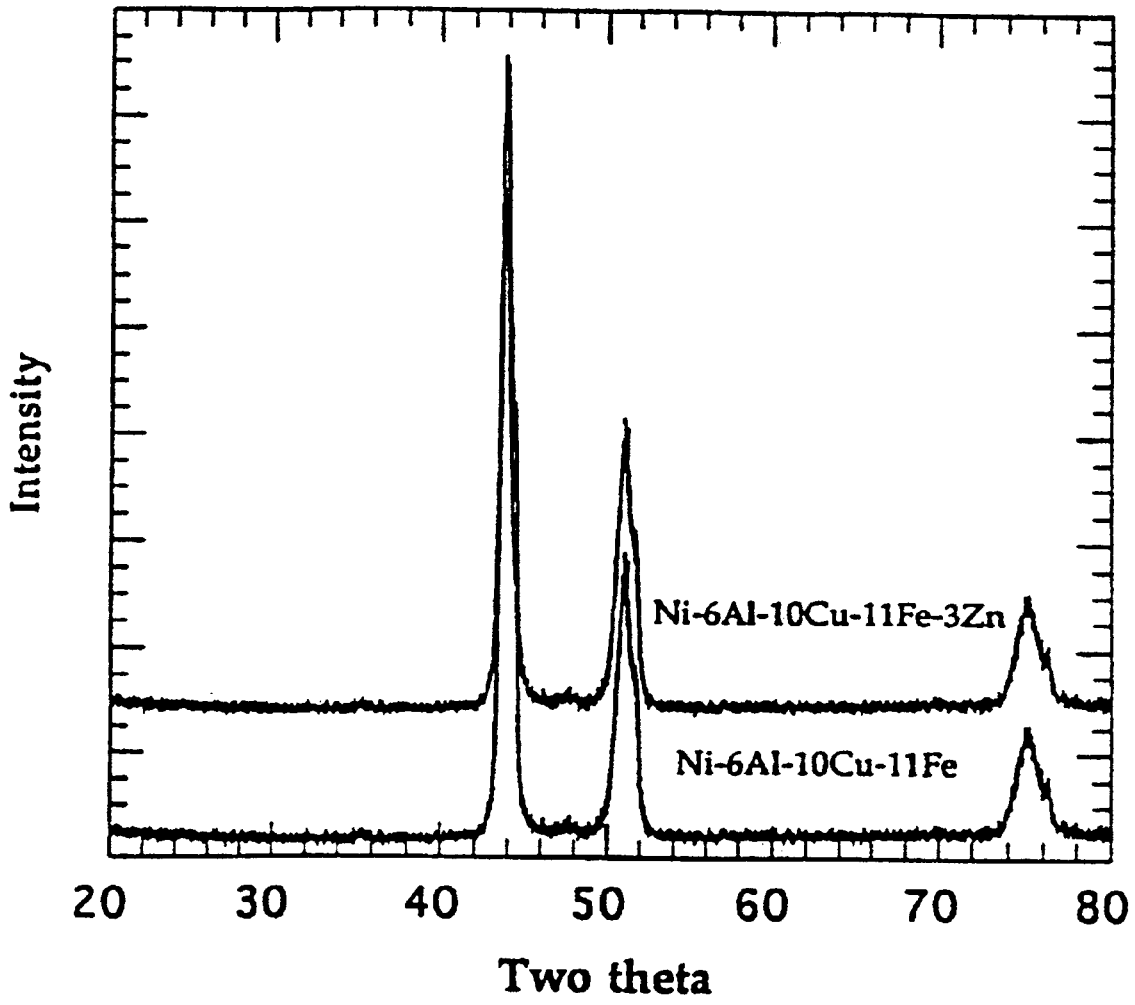
FIG. 1 shows X-ray diffraction spectra, at the Two-Theta position, of two metallic/intermetallic micropyretic reaction substrates, one without and the other with zinc as additive element.

The invention will be further described and will be compared to the prior art in the following Examples.

EXAMPLE 1

Comparative

A powder mixture was prepared from 73 wt % (68 atomic %) nickel, 100 mesh (<149 micrometer), 6 wt % (12 atomic %) aluminum, 325 mesh (<42 micrometer), 11 wt % (11 atomic %) iron, 10 micrometers particle size, and 10 wt % (9 atomic %) copper, 5–10 micrometers particle size. After mixing, the dry mixture (i.e. without any liquid fiber), was uniaxially pressed at a pressure of 176 Mpa for a holding time of 3 minutes.

The pressed samples were then ignited in a furnace at 900° C. or 1050° C. to initiate a micropyretic reaction in air.

All reacted specimens were inhomogeneous and semi-porous. Analysis of the specimens showed the following composition in atomic %: 59.8% nickel, 18.6% aluminum, 11.2% iron and 10.5% copper at the surface and 62.8% nickel, 13.9% aluminum, 12.3% iron, and 11.0% copper in the core. The intermetallic compound $NiAl_3$ was present.

Some specimens were then subjected to an oxidizing treatment in air at 1000° C. for several hours, typically 5 hours. Other specimens were not subjected to this oxidizing treatment and it has been found that this oxidizing treatment is not essential.

The specimens were then used as anodes in a cryolite-based electrolyte containing 7 wt % alumina and 1 wt % cerium fluoride at 980° C. A typical test for a specimen with an anode surface area of 22.4 $cm^2$ ran for a first period of 48 hours at a current density of 0.3 $A/cm^2$, followed by a second period of 54 hours at a current density of 0.5 $A/cm^2$. During the first period, the cell voltage was from 2.9 to 2.5 Volts, and during the second period the cell voltage was from 3.3 to 4.4 Volts. At the end of the test, the anode specimens were removed. The specimens showed no signs of dimensional change, and the metallic substrate of dense appearance was covered by a coarse, dense, uniform and well adhering layer of cerium oxyfluoride.

After the electrolytic test, the specimens were examined by scanning electron microscope and energy dispersive spectroscopy (SEM/EDS).

The cerium oxyfluoride coating appeared homogeneous and very dense, with no apparent porosity. On the surface of the specimen, below the cerium oxyfluoride coating, there was an in-situ formed composite oxide layer, total thickness about 300 micrometers, made up of three different oxide layers, as described above.

The outermost oxide layer was a homogeneous, dense, oxide-only layer devoid of fluoride. This oxide layer comprised oxides of nickel, aluminum and iron with predominant quantities of iron. The quantities of metals present in atomic % were 32% nickel, 21% aluminum, 45% iron and 2% copper. It is believed that this phase comprises nickel ferrite doped with aluminum.

The intermediate oxide layer was composed of large grains which interpenetrated with the outermost layer. Analysis showed no detectable fluoride, and the intermediate oxide layer comprised oxides of nickel and iron, with nickel highly predominant. The quantities of metals present in atomic % were 83% nickel, 3% aluminum, 13% iron and 1% copper. It is believed that this phase is iron-doped nickel oxide which would explain the good electrical conductivity of the cell component/anode and its resistance to dissolution during electrolysis.

The oxide layer below the intermediate layer was slightly more porous that the top two oxide layers. Analysis identified it is an oxide of nickel, aluminum and iron with aluminum highly predominant. A small quantity of fluoride was detected in the pores. The quantities of metals present in atomic % were 22.6% nickel, 53.87% aluminum, 21.54% iron and 1.99% copper. It is believed that this phase may be a homogeneous phase of aluminum oxide with iron and nickel in solid solution, forming an aluminate-rich layer such as an iron nickel aluminate.

The porous metal substrate in contact with the oxide layer is comprised of nickel with small quantities of copper, iron and aluminum. It is largely depleted in aluminum, as the aluminum is used to create the aluminate layer on top of it. The composition of the porous substrate in atomic % was 77.8% nickel, 5.3% aluminum, 3.5% iron and 13.5% copper.

The metallic core deeper inside the substrate is also depleted of aluminum as a result of internal oxidation in the open pores of the material and diffusion of the oxidized aluminum. Here, the composition in atomic % was 77.2% nickel, 1.8% aluminum, 9.7% iron and 11.3% copper.

All interconnecting pores in the metal substrate were filled with cryolite, and in some cryolite-filled pores, a second phase identified as aluminum fluoride is seen, probably resulting from phase separation during the cooling of the cryolite within the sample. No other metallic fluorides were detected in the metallic core.

The above procedure was repeated varying the proportions in the starting mixture, as shown in Table I. The resulting specimens were subjected to electrolytic testing as described above.

TABLE 1

| Ni/wt % | Al/wt % | Fe/wt % | Cu/wt % |
|---|---|---|---|
| 76.1 | 4.9 | 10 | 10 |
| 71.4 | 3.6 | 15 | 10 |
| 62 | 8 | 20 | 10 |
| 79 | 10 | 11 | 0 |
| 66.4 | 3.6 | 15 | 15 |
| 64 | 6 | 15 | 15 |
| 71 | 8 | 11 | 10 |

EXAMPLE 2

Comparative

The procedure of Example 1 was repeated varying the proportions in the starting mixture and with zirconium, chromium, titanium, yttrium or niobium as an extra component in a total amount up to 5 wt % of the total reactants. The particle size of the chromium was 325 mesh (<425 micrometer). The composition was nickel 73 wt %, aluminum 6 wt %, iron 6 wt %, copper 10 wt % and chromium or other additive up to 5 wt %. Results comparable to those for the samples of Example 1 were obtained.

EXAMPLE 3

The procedure of the preceding examples was repeated, but all compositions included silicon, tin or zinc as additives in an amount up to 5% of the total reaction mixture, to the base Ni—Al—Cu—Fe in the weight percentages shown in Table 2 below:

TABLE 2

| |
|---|
| 72Ni—6Al—10Cu—11Fe—1Si |
| 70Ni—6Al—10Cu—11Fe—3Si |
| 68Ni—6Al—10Cu—11Fe—5Si |
| 72Ni—6Al—10Cu—11Fe—1Zn |
| 70Ni—6Al—10Cu—11Fe—3Zn |
| 68Ni—6Al—10Cu—11Fe—5Zn |
| 72Ni—6Al—10Cu—11Fe—1Sn |
| 70Ni—6Al—10Cu—11Fe—3Sn |
| 68Ni—6Al—10Cu—11Fe—5Sn |

It was found that these samples exhibited superior oxidation resistance compared to the samples of Comparative Examples 1 and 2, in particular the selected additives resulted in formation of a thiner oxide layer, i.e. an oxide layer which grew at a much slower rate during oxidation than the oxide layers for the samples of Comparative Examples 1 and 2, as is apparent from the oxidation test data reported below.

Electrochemical and Gas Oxidation Testing

Compared to the (other) prior art, samples prepared according to comparative Examples 1 and 2, i.e. according to U.S. Pat. No. 5,510,008 and WO96/12833 (Sekhar et al), have shown outstanding properties as dimensionally stable anodes or anode substrates for aluminum production in the Hall-Héroult process, i.e. electrolysis of alumina dissolved in molten cryolite at temperatures of about 950°. The anodes also show outstanding long term resistance to oxidation when subjected to oxidation tests in air or oxygen at 950° C.

However, it has been observed that in long term electrolysis test, the samples "over-passivate" (as described below) hence reducing their useful life and compromising their viability. It has been postulated that the oxidizing conditions under anodic polarization in molten cryolite at 950° C. are more stringent than when the samples are heated in air/oxygen at the same temperature, and that the oxidizing conditions prevailing in a Hall Héroult cell at 950° C. could be "simulated" by exposing the samples to oxygen in an oven at temperature about 200° C. higher, i.e. at about 1150° C.

Tests, reported below, were therefore carried out to assess the resistance of the specimens to oxidation in air or oxygen at 1000° C. and 1150° C. It was found that the samples according to Comparative Examples 1 and 2 (generally according to the teaching of U.S. Pat. No. 5,510,008 and WO96/12833, Sekhar et al), formed a relatively thick oxide layer under these conditions. It seems probable that if these specimens are used as anodes in aluminum production, their useful life would be limited by the formation of such a thick oxide layer. Additionally, as the thickness rises beyond a certain threshold ("over-passivation"), mechanical stresses between the oxide and the anode body are great enough to cause the oxide layer to lose its integrity, causing part of the oxide layer to dissolve in the electrolyte. Furthermore, such growth can increase the overall resistance (reduced conductivity) and the overvoltage and lower the cell efficiency.

Surprisingly, it was found that with addition of the silicon, tin or zinc additives of this invention, the oxide surface layer was much thinner, i.e. it grew at a much slower rate than that for comparative examples 1 and 2. Moreover, the added metals, in particular zinc, are well tolerated in small quantities as impurities in the product aluminum.

The oxidation testing was carried out as follows: Samples prepared according to the preceding Examples were subjected to oxidation testing in a tube furnace at 1000° C. or 1150° C. in air under static conditions or with a high airflow rate (0.2 1/min), for a time of about 24 hours.

After removal from the furnace, the thickness of the oxide film formed was measured by an average of three readings from three different locations of each sample, in accordance with ASTM G54-90 procedures. The results of each series of measurements are reported in Table 3 below.

TABLE 3

| Composition (wt %) | Oxide Layer Thickness (mm) |
|---|---|
| Ni(73)Al(6)Cu(10)Fe(11) | 2.50 |
| Ni(72)Al(6)Cu(10)Fe(11)Zn(1) | 0.54 |
| Ni(70)Al(6)Cu(10)Fe(11)Zn(3) | 0.33 |
| Ni(72)Al(6)Cu(10)Fe(11)Sn(1) | 0.39 |
| Ni(70)Al(6)Cu(10)Fe(11)Sn(3) | 0.34 |
| Ni(72)Al(6)Cu(10)Fe(11)Si(1) | 0.35 |
| Ni(70)Al(6)Cu(10)Fe(11)Si(3) | 0.38 |

The zinc, silicon and tin additives led to a reduced oxide layer thickness due to the lowest growth rate compared to the sample without. Importantly, zinc is relatively better tolerated as an impurity in aluminum, than the additives of the prior art such as titanium and chromium. Comparatively, zinc is also better tolerated as an impurity than silicon and tin.

All of the samples with silicon, tin and zinc additives has a reduced oxide layer thickness compared to the samples without additives. The no-additives samples had a considerably thicker oxide layer thickness (about 5 to 10 times greater). It is believed that the lower growth rates of the samples with the additives of the present invention would allow aluminum production cells including such components as anodes, to be operated at much greater current densities than the traditional current densities of 0.3 to 0.5 A/cm2. It is believed that current densities of up to 8 A/cm2 would be possible.

X-ray Diffraction Analysis

Figure 2:
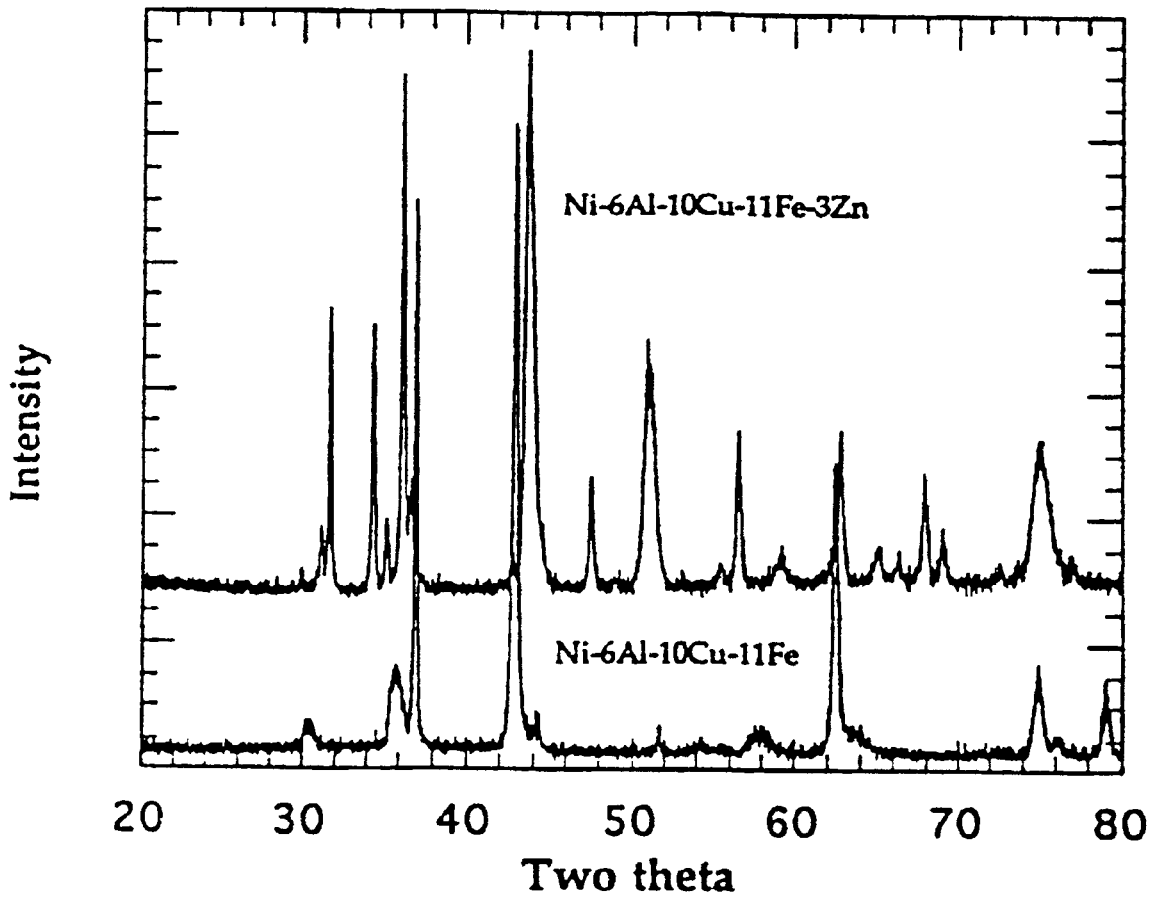
FIG. 2 shows corresponding X-ray diffraction spectra of the metallic/intermetallic micropyretic oxide layers formed on the substrates of FIG. 1.

The phase of the metallic/intermetallic substrate and the mixed oxide layer of samples produced according to Examples 1 and 3 were determined by X-ray diffraction. FIGS. 1 and 2 show the Two-Theta X-ray diffraction spectra of two samples, one with a composition Ni(73)Al(6)Cu(10)Fe(11) wt %, the other with a composition Ni(73)Al(6)Cu(10)Fe(11)Zn(3) parts by weight, before and after oxidation. As is well known, Theta is half the angle between the diffracted X-ray beam and the original X-ray beam direction. In a typical diffractometer, a moving X-ray detector records the 2 Theta angles at which the X-ray beams is diffracted, giving a characteristic diffraction pattern as seen in FIGS. 1 and 2. For more detailed information on X-ray diffraction, a textbook such as *The Science and Engineering of Materials,* D. R. Askeland, PWS Publishing Company (1994), may be consulted.

The primary phases of the metallic/intermetallic substrate are Ni and $Ni_3Al$, which indicates that the major reactions during the synthesis process are between Ni and Al particles. Cu and Fe have high solubility in Ni and $Ni_3Al$, and exist in solid solution in these phases or form minor amounts of copper and iron compounds such as NiCu and NiFe (not detected by the X-ray diffraction).

The mixed oxide layer is the part of the anode which contacted the cryolite alumina electrolyte during electrolytic testing. For the non-zinc specimen, this layer is primarily made up of NiO and $NiFe_2O_4$, which have low solubility in cryolite.

The addition of zinc does not change the phases of the substrate as shown in FIG. 1. Zn has a high solubility in the Ni and the $Ni_3Al$ and exists in solid solution or as zinc compounds in small amounts that are not detected by the X-ray diffraction.

As is apparent from FIG. 2, the mixed oxide layer formed with the zinc-containing specimen is significantly different, with formation of complex mixed oxides. The oxides include NiO, $NiFe_2O_4$, $NiZnFe_2O_4$ and ZnO. It is believed that the complex oxides density the mixed oxide layer and enhance the oxidation resistance, especially $NiZnFe_2O_4$.

Thus, it is apparent that there have been provided, in accordance with the invention, cell components which fully satisfy the objects and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations which fall within the spirit and broad scope of the appended claims.

What is claimed is:

1. A cell component for the electrowinning of aluminum by the electrolysis of alumina dissolved in a molten fluoride electrolyte, comprising;

a porous micropyretic reaction product of particulate nickel, aluminum, iron and optionally, copper, and of at least one additive element selected from the group consisting of silicon, tin, zinc, vanadium, indium, hafnium, tungsten, elements from the lanthanide series starting from praesodymium, and misch metal, in an amount ranging from 0.5 up to 8 wt % of the total, the porous micropyretic reaction product containing metallic and intermetallic phases, said additive elements being supplied in the form of an elemental powder, oxides of said elements, other compounds of said elements or mixtures thereof.

2. The cell component of claim 1, comprising a composite oxide surface formed in-situ by anodically polarizing the micropyretic reaction product in a molten fluoride electrolyte containing dissolved alumina, or ex situ by oxidizing the surface of the micropyretic reaction product in an oxidizing gas at high temperature.

3. The cell component of claim 2, wherein said composite oxide surface comprises an iron-rich relatively dense outer portion and an aluminate-rich relatively porous inner portion.

4. The cell component of claim 2, which is an anode.

5. The cell component of claim 2, wherein the composite oxide surface comprises nickel oxide, nickel ferrite and complex oxides including oxides of the additive element(s).

6. The cell component of claim 5, wherein the additive element is zinc and said complex oxides include nickel-zinc ferrite.

7. The cell component of claim 6, wherein said composite oxide surface comprises nickel oxide, nickel ferrite, zinc oxide and nickel-zinc ferrite.

8. The cell component of claim 2, which is an anode, the composite oxide surface whereof is coated with a coating of cerium oxyfluoride.

9. The cell component of claim 1, wherein the micropyretic reaction product is produced from particulate nickel, aluminum, iron, copper and the additive element in the amounts 50–90 wt % nickel, 3–20 wt % aluminum, 5–20 wt % iron, 0–15 wt % copper and 0.5–5 wt % of said at least one additive element from the group consisting of silicon, tin, zinc, vanadium, indium, hafnium, tungsten, elements from the lanthanide series starting from praesodymium, and misch metal.

10. The cell component of claim 9, wherein the micropyretic reaction product is produced from 60–80% wt % nickel, 3–10 wt % aluminum, 5–20 wt % iron, 5–15 wt % copper and 0.5–5 wt % of said at least one additive element from the group consisting of silicon, tin, zinc, vanadium, indium, hafnium, tungsten, elements from the lanthanide series starting from praesodymium, and misch metal.

11. The cell component of claim 1, produced from a mixture containing said at least one additive element from the group consisting of silicon, tin, zinc, vanadium, indium, hafnium, tungsten, elements from the lanthanide series starting from praesodymium, and misch metal in an amount of 0.5 to 5 wt % of the total, and at least one further additive element from the group consisting of chromium, manganese, titanium, molybdenum, cobalt, zirconium, niobium, tantalum, yttrium, cerium, lanthanum, oxygen, boron and nitrogen, the amount of all additives not exceeding 8 wt % of the total.

12. The cell component of claim 1, produced from a mixture comprising silicon as additive element in an amount of from 0.5 to 5 wt % of the total.

13. The cell component of claim 1, produced from a mixture comprising tin as additive element in an amount of from 0.5 to 5 wt % of the total.

14. The cell component of claim 1, produced from a mixture comprising zinc as additive element in an amount of from 0.5 to 5 wt % of the total.

15. The cell component of claim 1, wherein the micropyretic reaction product comprises at least one ordered intermetallic compound from the group consisting of nickel-iron, nickel-aluminum, aluminum-iron, nickel-aluminum-copper and nickel-aluminum iron-copper containing intermetallic compounds.

16. The cell component of claim 15, wherein the micropyretic reaction product comprises Ni, $Ni_3Al$, NiCu and NiFe.

17. A method of manufacturing a cell component for the electrowinning of alumina by the electrolysis of alumina in a molten fluoride electrolyte, comprising:

initiating a micropyretic reaction of a mixture of particulate nickel, aluminum, iron and optionally, copper, and at least one additive element selected from the group consisting of silicon, tin, zinc, vanadium, indium, hafnium, tungsten, elements from the lanthanide series starting from praesodymium, and misch metal in an amount ranging from 0.5 up to 8 wt % of the total reaction mixture, to produce a porous micropyretic reaction product containing metallic and intermetallic phases, said additive elements being supplied in the form of an elemental powder, oxides of said elements, other compounds of said elements or mixtures thereof.

18. The method of claim 17, further comprising anodically polarizing the micropyretic reaction product in said molten fluoride electrolyte to produce, from the metallic and intermetallic phases contained in the porous micropyretic reaction product, a composite oxide surface formed in-situ.

19. The method of claim 18, wherein said cell component is an anode.

20. The method of claim 18, wherein the micropyretic reaction product is produced from particulate nickel, aluminum, iron, copper and the additive element(s) in the amounts 50–90 wt % nickel, 3–20 wt % aluminum, 5–20 wt % iron, 0–15 wt % copper and 0.5–5 wt % of said at least one additive element from the group consisting of silicon, tin, zinc, vanadium, indium, hafnium, tungsten, elements from the lanthanide series starting from praesodymium, and misch metal.

21. The method of claim 20, wherein the micropyretic reaction product is produced from 60–80 wt % nickel, 3–10 wt % aluminum, 5–20 wt % iron, 5–15 wt % copper and 0.5–5 wt % of said at least one additive element from the group consisting of silicon, tin, zinc, vanadium, indium, hafnium, tungsten, elements from the lanthanide series starting from praesodymium, and misch metal.

22. The method of claim 18, wherein the in-situ composite oxide surface is formed in a molten cryolite electrolyte containing dissolved alumina and cerium, and an in-situ cerium oxyfluoride coating is formed on the composite oxide surface.

23. The method of claim 17, further comprising exposing the surface of the micropyretic reaction product to oxidizing gas at high temperature to produce, from the metallic and intermetallic phases contained in the porous micropyretic reaction product, a composite oxide surface.

24. The method of claim 18 or 23, wherein said composite oxide surface comprises an iron-rich relatively dense outer portion and an aluminate-rich relatively porous inner portion.

25. The method of claim 17, wherein the reaction mixture contains said at least one additive element from the group consisting of silicon, tin, zinc, vanadium, indium, hafnium, tungsten, elements from the lanthanide series starting from praesodymium, and misch metal in an amount of 0.5 to 5 wt % of the total, and at least one further additive element from the group consisting of chromium, manganese, titanium, molybdenum, cobalt, zirconium, niobium, tantalum, yttrium, cerium, lanthanum, oxygen, boron and nitrogen, the amount of all additives not exceeding 8 wt % of the total.

26. The method of claim 17, wherein the reaction mixture contains as additive element from 0.5 to 5 wt % of silicon.

27. The method of claim 17, wherein the reaction mixture contains as additive element from 0.5 to 5 wt % of tin.

28. The method of claim 17, wherein the reaction mixture contains as additive element from 0.5 to 5 wt % of zinc.

29. The method of claim 17, wherein the particulate nickel has a larger particle size than the particulate aluminum, iron, copper and additive element(s).

30. A method of electrowinning aluminum by the electrolysis of alumina in a molten fluoride electrolyte, comprising:

providing a starter anode which is a porous micropyretic reaction product comprising metallic and intermetallic phases produced by reacting a micropyretic reaction mixture of particulate nickel, aluminum, iron and optionally, copper, and at least one additive element from the group consisting of silicon, tin, zinc, vanadium, indium, hafnium, tungsten, elements from the lanthanide series starting from praesodymium, and misch metal in an amount ranging from 0.5 up to 8 wt % of the total, said additive elements being supplied in the form of an elemental powder, oxides of said elements, other compounds of said elements or mixtures thereof;

oxidizing the surface of the starter anode to produce, from the metallic and intermetallic phases contained in the porous micropyretic reaction product, a composite oxide surface, in situ in a molten fluoride electrolyte or by exposure to an oxidizing gas; and anodically polarizing the anode in a molten fluoride electrolyte containing dissolved alumina to produce aluminum in an aluminum production cell.

31. The method of claim 30, wherein the starter anode is anodically polarized in a molten fluoride electrolyte containing dissolved alumina and electrolysis is continued in the same or a different aluminum production cell.

32. The method of claim 31, wherein an in-situ composite oxide surface is formed in a molten cryolite electrolyte containing dissolved alumina and cerium, and an in-situ cerium oxyfluoride coating is formed on the composite oxide surface.

33. The method of claim 31, wherein an in-situ composite oxide surface is formed in a first molten cryolite electrolyte containing dissolved alumina, and electrolysis is continued in a second molten cryolite electrolyte containing dissolved alumina and cerium wherein an in-situ formed cerium oxyfluoride coating is formed on the composite oxide surface.

34. The method of claim 30, wherein the micropyretic reaction product is produced from particulate nickel, aluminum, iron, copper and additive element(s) in the amounts 50–90 wt % nickel, 3–20 wt % aluminum, 5–20 wt % iron, 0–15 wt % copper and 0.5–5 wt % of at least one element from the group consisting of silicon, tin, zinc, vanadium, indium, hafnium, tungsten, elements from the lanthanide series starting from praesodymnum, and misch metal.

35. The method of claim 34, wherein the micropyretic reaction product is produced from 60–80 wt % nickel, 3–10 wt % aluminum, 5–20 wt % iron, 5–15 wt % copper and 0.5–5 wt % of at least one element from the group consisting of silicon, tin, zinc, vanadium, indium, hafnium, tungsten, elements from the lanthanide series starting from praesodymium, and misch metal.

36. The method of claim 30, wherein the micropyretic reaction product is produced from a mixture containing said at least one additive element from the group consisting of silicon, tin, zinc, vanadium, indium, hafnium, tungsten, elements from the lanthanide series starting from praesodymium, and misch metal in an amount of 0.5 to 5 wt % of the total, and at least one further additive element from the group consisting of chromium, manganese, titanium, molybdenum, cobalt, zirconium, niobium, tantalum, yttrium, cerium, lanthanum, oxygen, boron and nitrogen, the amount of all additives not exceeding 8 wt % of the total.

37. The method of claim 30, wherein said cell is operated at an anode current density up to 8 Amps/cm2.

38. A precursor of a cell component of an aluminum production cell, which is ignitable to produce by micropyretic reaction the cell component, the precursor being made of a composite material comprising particulate nickel, aluminum, iron and, optionally, copper, and at least one additive element selected from the group consisting of silicon, tin, zinc, vanadium, indium, hafnium, tungsten, elements from the lanthanide series starting from praesodymium, and misch metal, said additive element being present in an amount ranging from 0.5 up to 8 weight percent of the total precursor, said elements being supplied in the form of an elemental powder, oxides of said additive elements, other compounds of said elements or mixture thereof.

39. The precursor of claim 38, wherein said cell component is an anode.

40. The precursor of claim 38, comprising 50–90 weight % nickel, 3–20 weight % aluminum, 5–20 weight % iron, 0–15 weight % copper and 0.5–5 weight % of said additive element(s).

41. The precursor of claim 40, comprising 60–80 weight % nickel, 3–10 weight % aluminum, 5–20 weight % iron and 5–15 weight % copper.

42. The precursor of claims 38, comprising at least one additive element from the group consisting of silicon, tin, zinc, vanadium, indium, hafnium, tungsten, elements from the lanthanide series starting from praesodymium, and misch metal in an amount of 0.5 to 3 wt % of the total, and at least one further additive element from the group consisting of chromium, manganese, titanium, molybdenum, cobalt, zirconium, niobium, tantalum, yttrium, cerium, lanthanum, oxygen, boron and nitrogen, the amount of all additives not exceeding 8 wt % of the total.

43. The precursor of claim 38, comprising silicon as the additive element in an amount from 0.5–5 weight % of the total.

44. The precursor of claim 38, comprising zinc as the additive element in an amount from 0.5–5 weight % of the total.

45. The precursor of claim 38, comprising tin as the additive element in an amount from 0.5–5 weight % of the total.

* * * * *